US006249298B1

(12) United States Patent
Castegnier et al.

(10) Patent No.: US 6,249,298 B1
(45) **Date of Patent: *Jun. 19, 2001**

(54) SIGNAL PROCESSING DEVICE FOR CORRECTING PIXEL DENSITY IN AN ELECTROCOAGULATION PRINTING APPARATUS

(75) Inventors: Adrien Castegnier, Outremont; Guy Castegnier, Iles des Soeurs; Pierre Castegnier; Charles Goyette, both of Montreal, all of (CA)

(73) Assignee: Elcorsy Technology Inc., Saint-Laurent (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/299,987

(22) Filed: Apr. 27, 1999

Related U.S. Application Data

(62) Division of application No. 08/997,357, filed on Dec. 23, 1997.

(51) Int. Cl.[7] ..... B41J 2/36
(52) U.S. Cl. ..... 347/188; 347/191
(58) Field of Search ..... 347/237, 247, 347/254, 188, 191, 190, 211; 358/448, 443; 204/483, 623

(56) References Cited

U.S. PATENT DOCUMENTS 4,895,629 1/1990 Castegnier ..... 204/180.9

*Primary Examiner*—Thinh Nguyen
*Assistant Examiner*—Hai C. Pham
(74) *Attorney, Agent, or Firm*—Swabey Ogilvy Renault

(57) ABSTRACT

A pixel density correction device for processing a signal containing pixel density values conveyed to a printing head of an electrocoagulation printing apparatus that includes a plurality of simultaneously addressable electrodes. The pixel density correction device of the invention comprises an input for receiving the signal representative of pixel density values associated with the simultaneously addressable electrodes, and a processing element for altering a pixel density value of a selected one of the simultaneously addressable electrodes, the signal processing element being responsive to pixel density values associated with electrodes other than the selected electrode to determine a corrected pixel density value associated with the selected electrode.

14 Claims, 10 Drawing Sheets

SIGNAL PROCESSING DEVICE FOR CORRECTING PIXEL DENSITY IN AN ELECTROCOAGULATION PRINTING APPARATUS

This Application is a Division of application Ser. No. 08/997,357, filed Dec. 23, 1997.

The present invention pertains to improvements in the field of electrocoagulation printing. More particularly, the invention relates to an improved printing head for reproducing an image by electrocoagulation of an electrolytically coagulable colloid.

BACKGROUND OF THE INVENTION

In U.S. Pat. No. 4,895,629 of Jan. 23, 1990, Applicant has described a high-speed electrocoagulation printing method and apparatus in which use is made of a positive electrode in the form of a revolving cylinder having a passivated surface onto which dots of colored, coagulated colloid representative of an image are produced. These dots of colored, coagulated colloid are thereafter contacted with a substrate such as paper to cause transfer of the colored, coagulated colloid onto the substrate and thereby imprint the substrate with the image. As explained in this patent, the surface of the positive electrode is coated with a dispersion containing an olefinic substance and a metal oxide prior to electrical energization of the negative electrodes in order to weaken the adherence of the dots of coagulated colloid to the positive electrode and also to prevent an uncontrolled corrosion of the positive electrode. In addition, gas generated as a result of electrolysis upon energizing the negative electrodes is consumed by reaction with the olefinic substance so that there is no gas accumulation between the negative and positive electrodes.

The electrocoagulation printing ink which is injected into the gap defined between the positive and negative electrodes consists essentially of a liquid colloidal dispersion containing an electrolytically coagulable colloid, a dispersing medium, a soluble electrolyte and a coloring agent. Where the coloring agent used is a pigment, a dispersing agent is added for uniformly dispersing the pigment into the ink. After coagulation of the colloid, any remaining non-coagulated colloid is removed from the surface of the positive electrode, for example, by scraping the surface with a soft rubber squeegee, so as to fully uncover the colored, coagulated colloid which is thereafter transferred onto the substrate. The surface of the positive electrode is then cleaned to remove therefrom any remaining coagulated colloid.

The optical density of the dots of colored, coagulated colloid, hereinafter referred to as "pixels", may be varied by varying the voltage and/or pulse duration of the pulse-modulated signals applied to the negative electrodes. As a typical example, the printing head which carries the negative electrodes may comprise 2048 electrodes which are arranged to define 64 groups or channels each having 32 electrodes. By proper electronic circuitry, it is possible to sequentially scan the electrodes of each channel while performing such a scanning simultaneously for all channels, and to apply a pulse-modulated signal to selected ones of the electrodes during scanning to energize same. The pulse-modulated signal may have a pulse duration ranging from about 15 to about 4000 nanoseconds. An electrical signal with a pulse duration of 150 nanoseconds provides a pixel having an optical density of 0.02 (very light gray), whereas an electrical signal with a pulse duration of 4000 microseconds provides a pixel having an optical density of 1.50 (black). It is also possible to vary the pulse duration by a predetermined number of time increments, for example, 63 increments of about 60 nanoseconds each or 255 increments of about 15 nanoseconds each, depending upon the level of fidelity of reproduction required. A signal whose pulse duration can be varied from 15 to 4000 nanoseconds in 255 increments delivers of course the best tone reproduction. Thus, in this case, the printing of a pixel starts with a pulse duration of about 15 nanoseconds, progresses with 255 increments of about 15 nanoseconds up to 4000 nanoseconds and stops when the desired optical density is reached.

The negative electrodes are arranged in rectilinear alignment to define a series of corresponding negative electrode active surfaces which are disposed in a plane parallel to the rotation axis of the positive electrode and spaced from the surface thereof by a constant predetermined gap filled with the aforesaid electrocoagulation printing ink. Electrical energization of selected ones of the negative electrodes causes point-by-point selective coagulation and adherence of the colloid onto the olefin and metal-oxide coated positive electrode surface opposite the electrode active surfaces of the energized negative electrodes while the positive electrode is rotating, thereby forming the aforesaid dots of colored, coagulated colloid or pixels. The addressing mode of the negative electrodes is such that at any given time, a signal is impressed at a single electrode in each and every channel. In the example given above, at the beginning of the electrocoagulation printing, current injection is performed simultaneously through the 1st electrode of every channel; thus, 64 non-contiguous electrodes are energized at the same time. At the next cycle, the 2nd electrode in every channel is energized. This procedure is repeated until all the electrodes of the linear array have been energized.

Since the negative electrodes energized at any given point in time are non-contiguous and the film of electrocoagulation printing ink on the surface of the positive electrode constantly moves relative to the linear array of negative electrodes due to the rotation of the positive electrode, the electrode addressing mode creates a saw-toothed image resulting from the displacement of two adjacent pixels relative to one another along the direction of rotation of the positive electrode. Such a displacement is function of the time frame between the electrical energization of consecutive electrodes and also function of the speed of rotation of the positive electrode. The quality of the image thus reproduced is obviously less than perfect. Applicant has also observed the occurrence of overly dense pixels.

SUMMARY OF THE INVENTION

It is therefore an object of the invention to overcome the above drawbacks and to provide a printing head system for electrocoagulation printing, that is capable of improving the quality of the image reproduced by electrocoagulation of an electrolytically coagulable colloid.

It is another object of the invention to provide a device for correcting the optical density of the pixels produced by electrocoagulation of an electrolytically coagulable colloid, with a view to limiting the occurrence of overly dense pixels.

According to one aspect of the invention there is thus provided a printing head system for an electrocoagulation printing apparatus, comprising:

an electrode carrier;

a linear array of electrolytically inert electrodes electrically insulated from one another and mounted to the electrode carrier, the array of electrodes being arranged into a plurality of groups each having a predetermined number of closely spaced electrodes; and a driver circuit for addressing the electrodes of selected groups, the driver circuit being responsive to a graphical data input signal to cause simultaneous passage of electric current through at least a major portion of the electrodes in a selected one of the groups, the major portion of electrodes including electrodes that are contiguous with one another.

In a most preferred embodiment, the electrode carrier is made of an electrically insulating material in which is embedded the array of electrodes, the active surfaces of the electrodes forming a continuous plane with the outer surface of the carrier. The electrodes of the array are arranged in rectilinear alignment along the length of the carrier. A driver circuit mounted inside the printing head impresses graphical data signals at selected electrodes of the array to induce current flow through the electrocoagulation printing ink contained in the electrode gap. The electrodes of the array are arranged into a plurality of consecutive groups, each group forming a segment of the array. The driver circuit in the printing head is designed to address the electrodes of a given group simultaneously. Preferably, electric current is caused to flow through every electrode of the group at or about the same instant in time. The current injection for each electrode of the group begins at the same time, however, the duration of the current injection will vary from one electrode to the other in accordance with the graphical data of the input signal. The expressions "simultaneous addressing of electrodes", "simultaneous current injection" and "simultaneous signal impressing" as used herein refer to the occurrence of current flow or impression of voltage at two electrodes such that at a given point in time current or voltage exists in every electrode. These expressions do not imply that the current injection or voltage application are co-extensive in time from one electrode to another, nor that the current injection or voltage application is initiated concurrently from one electrode to another or terminate concurrently from one electrode to another.

In another preferred embodiment, the printing head comprises 2048 electrodes arranged into 32 groups of 64 individual electrodes each. As discussed above, the driver circuit addresses simultaneously the electrodes in a given group. A single electrocoagulation cycle is effected when the driver circuit has addressed the electrodes of each group. The groups of electrodes are addressed consecutively in a successive order, the first group being addressed first, followed by the second group up until the 32nd group. Such an electrode addressing mode enables one to significantly improve the quality of the image reproduced by electrocoagulation and to thus eliminate saw-toothed images. Although the sequential group addressing results in a shift between adjacent pixels on either side of the boundary separating two contiguous groups, such a shift has not been found particularly objectionable as it is very difficult to perceive visually.

The present invention also provides, in another aspect thereof, a method of transferring graphical data to an electrocoagulation printing ink containing an electrolytically coagulable colloid. The method of the invention comprises the steps of:

a) providing a linear array of electrolytically inert electrodes electrically insulated from one another and in contact with a film of the ink moving along a predetermined direction, the array of electrodes being arranged into a plurality of groups each having a predetermined number of closely spaced electrodes; and b) addressing the electrodes of selected groups in response to a signal containing the graphical data, to cause simultaneous passage of electric current through at least a major portion of the electrodes in a selected one of the groups, the major portion of electrodes including electrodes that are contiguous with one another, thereby simultaneously inducing localized coagulation of the colloid at a plurality of contiguous sites arranged along an imaginary line extending generally transverse to the aforesaid predetermined direction.

According to a further aspect of the invention, there is provided in an electrocoagulation printing apparatus including a printing head carrying a linear array of electrolytically inert electrodes electrically insulated from one another, the array of electrodes being arranged into a plurality of groups each having a predetermined number of closely spaced electrodes, the improvement comprising a signal processing device for correcting pixel density, the signal processing device including:

an input for receiving a signal representative of a pixel density value associated with each electrode in one of the groups of electrodes;

a signal processing circuit for altering a pixel density value associated with a selected electrode in the one group of electrodes at least partially in dependence of pixel density values associated with other electrodes in the one group; and an output coupled to the selected electrode for supplying thereto the altered pixel density value.

In a most preferred embodiment, the signal processing circuit analyses the pixel density values associated with the respective electrodes of the currently addressed group. The pixel density value for each electrode in the group is corrected in accordance with the pixel density values of the other electrodes in the group. More specifically, Applicant has observed that overly dense pixels occur in instances where there is a significant difference between pixel density values associated with different electrode sub-groups. More specifically, when a first sub-group of electrodes is assigned high pixel density values (light print) and a neighboring sub-group of electrodes is assigned small pixel density values (dark print), the sub-group corresponding to the dark print zones will create overly dark pixels. It is believed that such over darkening is the result of impedance variations in the electrocoagulation printing ink. When electrodes are actuated, this produces in the neighboring regions of the ink lower impedance. As a result, higher currents occur through neighboring electrodes that may explain the undesirable density increase. To avoid this problem, the signal processing circuit alters the signal representative of the graphical data supplied to the printing head so that the pixel density values associated with the dark sub-group of electrodes are corrected to compensate for the interaction with the light sub-group.

The present invention further provides a pixel density correction device for processing a signal containing pixel density values conveyed to a printing head of an electrocoagulation printing apparatus that includes a plurality of simultaneously addressable electrodes. The pixel density correction device of the invention comprises:

an input for receiving the signal representative of pixel density values associated with the simultaneously addressable electrodes; and a processing element for altering a pixel density value of a selected one of the simultaneously addressable electrodes, the signal processing element being responsive to pixel density values associated with electrodes other than the selected electrode to determine a corrected pixel density value associated with the selected electrode.

In a preferred embodiment, the signal processing element is operative to reduce a pixel density value of the selected electrode in dependence of pixel density values associated with electrodes other than the selected electrode.

The present invention also provides a method of correcting pixel density, comprising the steps of:

a) processing a signal containing pixel density values conveyed to a printing head of an electrocoagulation printing apparatus that includes a plurality of simultaneously addressable electrodes to determine a corrected pixel density value for a selected one of the simultaneously addressable electrodes in dependence of pixel density values associated with electrodes other than the selected electrode; and b) outputting the corrected pixel density value.

According to a particularly preferred embodiment of the invention, the driver circuit of the printing head includes a current limiting system for limiting the magnitude of electric current passing through each electrode to a predetermined value. Such a system can be used in conjunction with the pixel density correction device to limit or completely eliminate the occurrence of overly dense pixels. In a most preferred embodiment, the current limiting system includes current sources that can maintain the magnitude of the electric current passing through each electrode to a predetermined level. Accordingly, impedance variations are less likely to alter the current magnitude through the electrodes, with the result that every electrode will locally coagulate the ink at predicted levels.

BRIEF DESCRIPTION OF THE DRAWINGS

Further features and advantages of the invention will become more readily apparent from the following description of preferred embodiments, reference being made to the accompanying drawings, in which.

DESCRIPTION OF PREFERRED EMBODIMENTS

Figure 1:
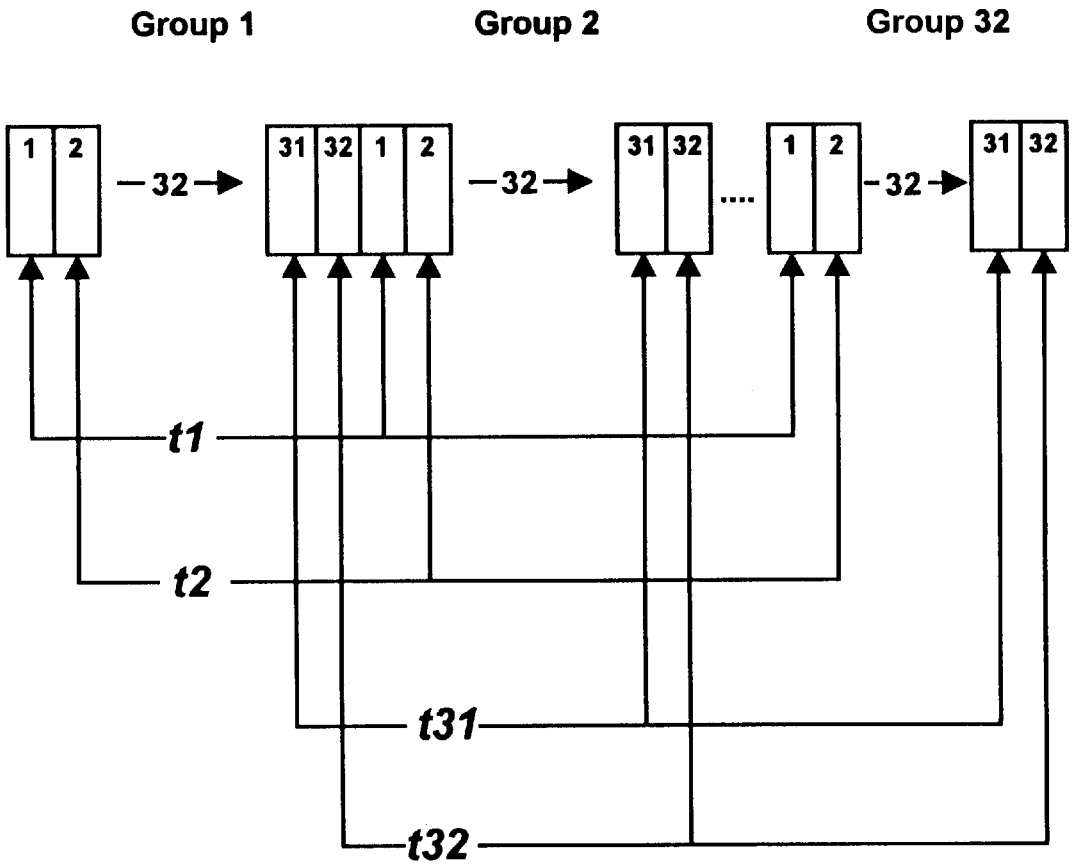
Figure 1 (Prior Art)
FIG. 1 is a general schematic view illustrating the configuration of the electrodes array in a prior art printing head for use in an electrocoagulation printing apparatus.

FIG. 1 illustrates the configuration of the negative electrodes in a prior art printing head. The printing head comprises a linear array of 2048 electrodes that are arranged into 64 groups each having 32 electrodes. The electrodes of the array are disposed along an imaginary line which extends generally transversely to the direction of movement of the film of electrocoagulation printing ink carried by the positive electrode. A driver circuit (not shown) electrically energizes selected ones of the negative electrodes to cause point-by-point selective coagulation of the colloid present in the ink, opposite the surfaces of the energized electrodes. The level of coagulation of the colloid depends on the voltage and pulse duration of the pulse-modulated signals applied to the negative electrodes. For practical reasons, the voltage is held constant and only the pulse duration is varied to control the level of coagulation. In turn, the level of coagulation determines the optical density of each pixel in the image which is ultimately transferred onto the substrate.

The electrode addressing scheme of the prior art printing head is such that at time t1 the 1st electrode of each and every group is energized. The next current injection event occurring at t2 renders only the second electrode of each and every group active. This sequence is continued until every electrode of the array has been activated. In the example given above, a complete activation cycle requires 64 current injection events, one event rendering 32 electrodes active.

Figure 2:
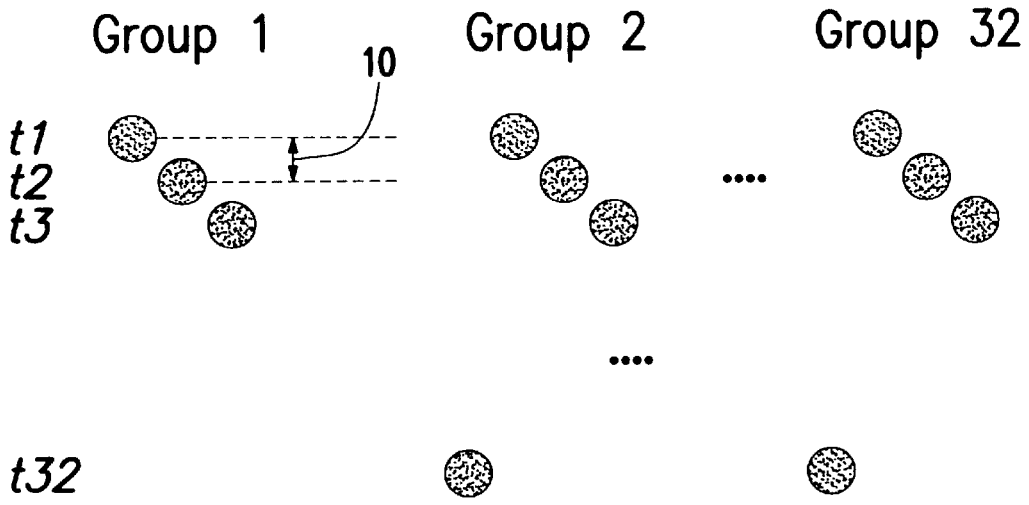
Figure 2 (Prior Art)
FIG. 2 illustrates the distribution of the locally coagulated sites in the electrocoagulation printing ink, that are created with the electrode configuration shown in FIG. 1.

During each current injection event, the electrodes that are being activated are non-contiguous. In the arrangement shown at FIG. 1, the distance between two active electrodes corresponds to the width of 31 electrodes. In other words, 31 inactive electrodes separate the active electrodes. Such an electrode addressing scheme creates the pixel distribution profile shown at FIG. 2. This profile is characterized by a displacement of adjacent pixels relative to one another that results from the movement of the film of the electrocoagulation printing ink between successive current injection events. In FIG. 2, this displacement is designated by reference numeral 10. The displacement is primarily function of the time between successive current injection events and the speed at which the film of electrocoagulation printing ink moves. The displacement may be important since electrocoagulation printing systems are designed to operate at high speed. For example, for a printing speed of one meter per second, the inter-pixel shift (or localized coagulation site) is of 128 micrometers when the current injection events occur at 4 microseconds intervals.

The inter-pixel shift depicted at FIG. 2 is undesirable since it is easily perceived by the human eye and it adversely affects the quality of the image as it creates a saw-toothed image.

Figure 3:
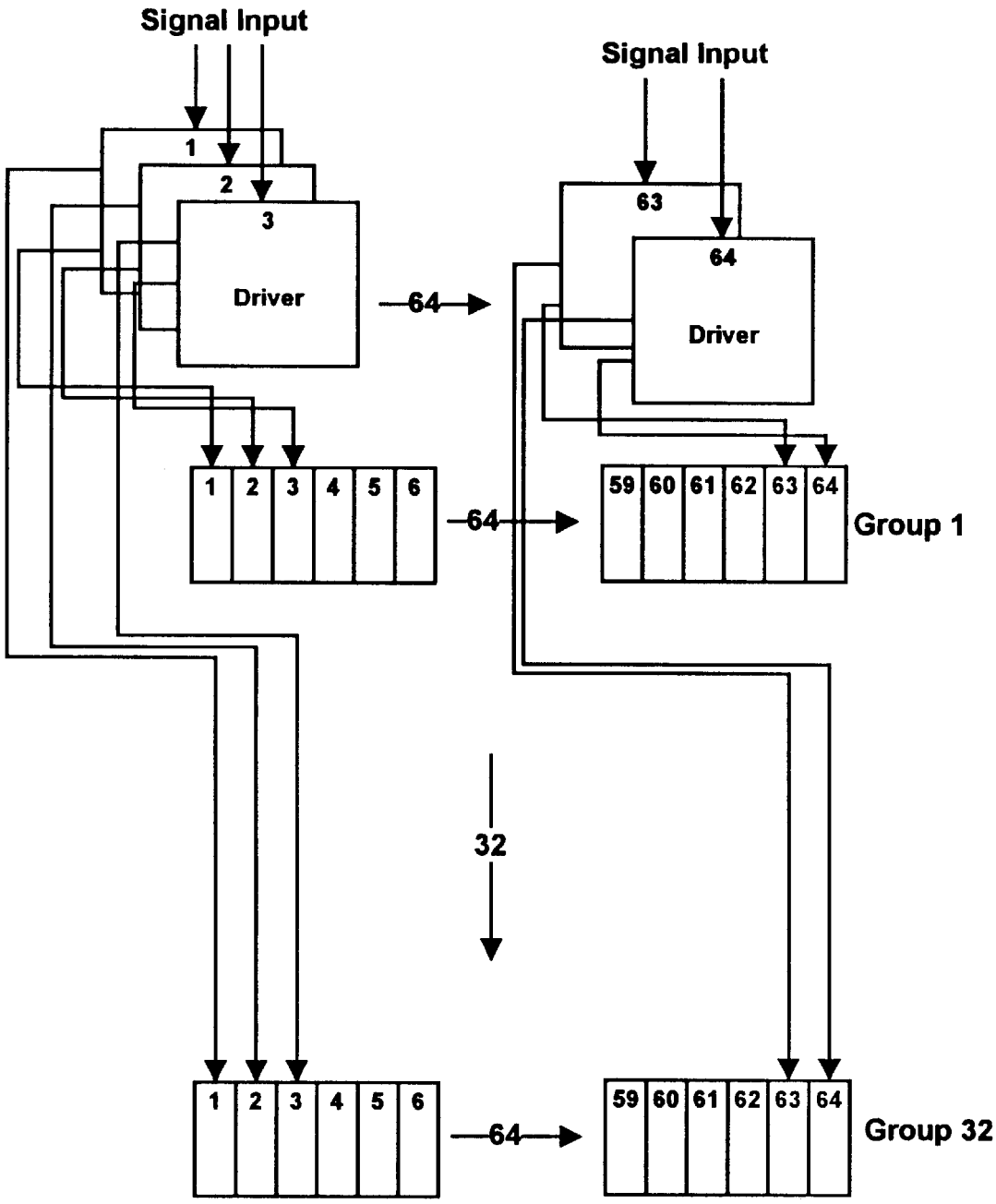
FIG. 3 is a schematic view of the array of electrodes in a printing head according to a preferred embodiment of the invention.

To solve the above problem, the present invention provides a printing head that uses a different electrode addressing scheme. FIG. 3 illustrates schematically the connection between the electrodes and the driver circuit that controls the activation of the electrodes. Physically, the electrodes are disposed in the same manner as in the prior art printing head depicted in FIG. 1. For ease of illustration, the various electrode groups have been shown at FIG. 3 as being vertically offset; however, it should be understood that the electrode groups are arranged consecutively to form the linear array shown in FIG. 1. A plurality of driver modules are mounted in the printing head for energizing selected ones of the electrodes. The printing head is provided with 64 driver modules, each module being connected to a respective electrode of every group. More specifically, module No. 1 is connected to electrode No. 1 of group 1, 25 electrode No. 1 of group 2, etc. Driver module No. 2 is connected to electrode No. 2 of group 1, electrode No. 2 of group 2, etc.

Figure 4:
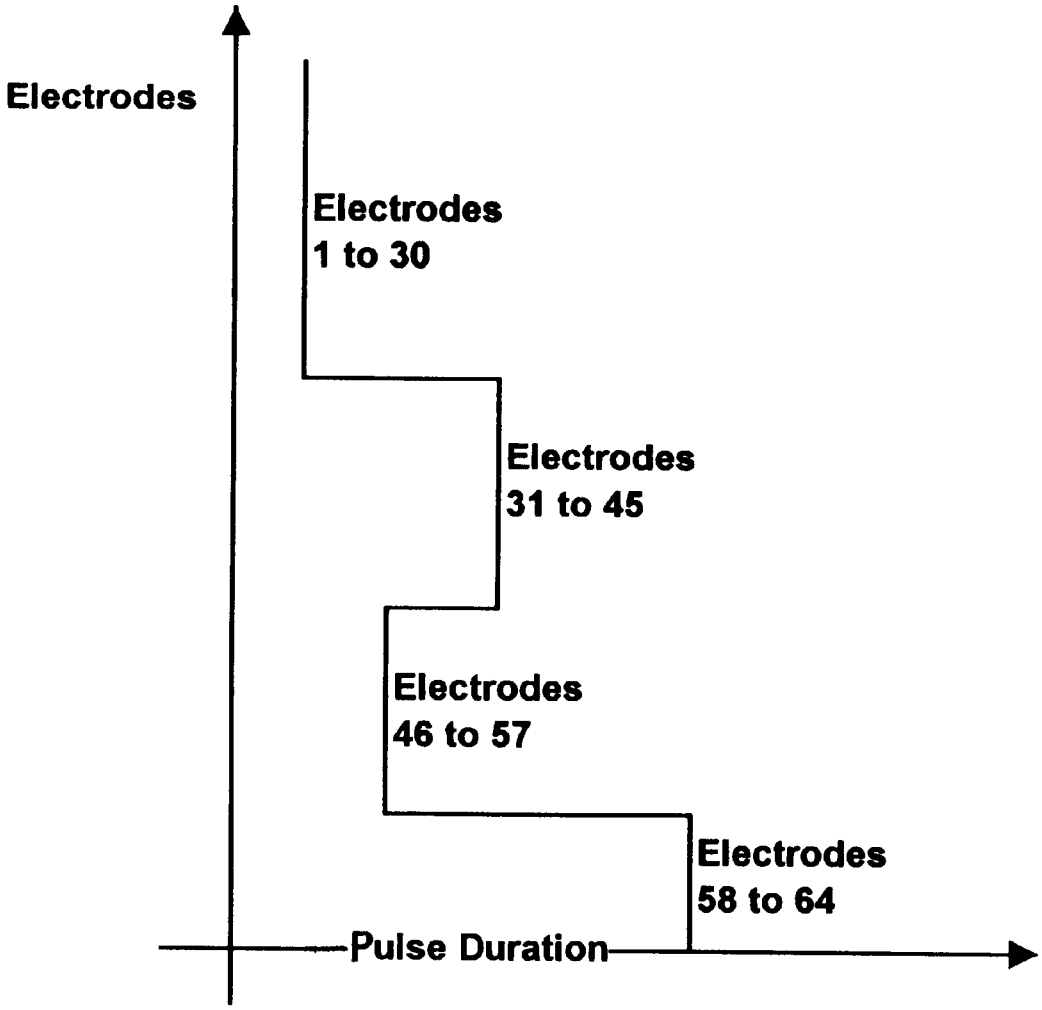
FIG. 4 is a diagram illustrating the pulse duration through the electrodes of a selected group designed to create in the electrocoagulation printing ink sites of different level of coagulation.

In operation, at time t1 each driver module impresses a signal on the conductor leading to the associated electrode of the first group. Preferably, the voltage level of the signal is uniform across the electrodes of the group. In a most preferred embodiment, the voltage is about 40–60 volts. The pulse duration of the pulse-modulated signal, however, usually varies from one electrode to another. This enables to coagulate the colloid present in the electrocoagulation printing ink in contact with the electrodes of a selected group according to a pattern corresponding to the graphical data contained in the signal that is communicated to the printing head. FIG. 4 best shows this feature. In this example, the electrocoagulation printing ink at the sites associated with electrode Nos. 1 to 30 will be coagulated the least since the pulse duration of the signal applied to this sub-group of electrodes is the shortest. A higher level of coagulation will be obtained at the sites associated with electrode Nos. 31 to 45. The level of coagulation at the sites associated with electrode Nos. 46 to 57 is at a level intermediate between the levels for electrode Nos. 1 to 30 and Nos. 31 to 45. Finally, the level of coagulation is highest at the sites associated with electrode Nos. 58 to 64 where the pulse duration is the longest.

A highly coagulated electrocoagulation printing ink will produce a dark pixel when the coagulated ink is transferred onto a suitable substrate, such as paper. Thus, in the above example, the sub-group of electrode Nos. 1 to 30 will create 30 relatively light pixels. Electrode Nos. 58 to 64 will form dark pixels. The pixels formed by the remaining electrodes of the group will have optical density values between those of sub-groups 1 to 30 and 58 to 64.

Figure 5:
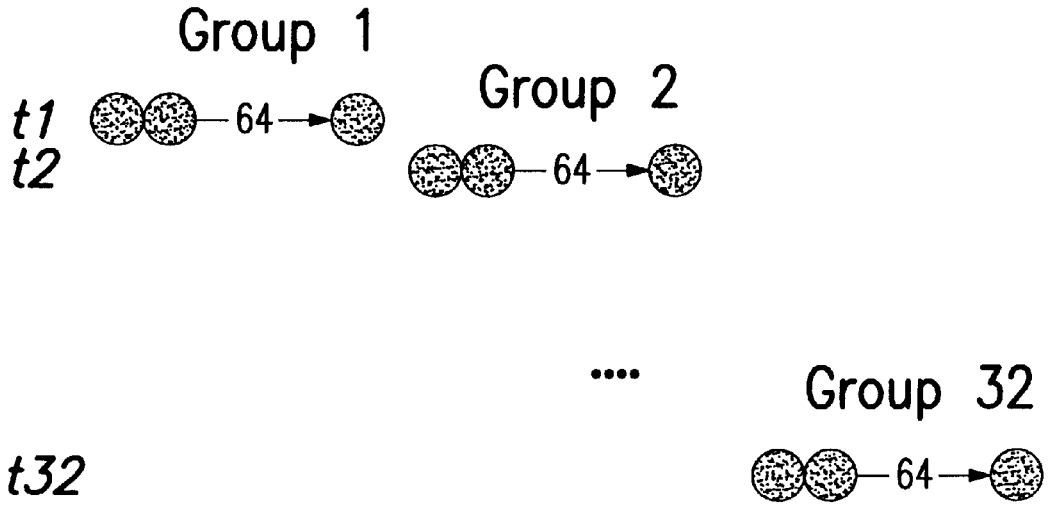
FIG. 5 illustrates the distribution of the localized coagulation sites in the electrocoagulation printing ink obtained by using a printing head in accordance with the invention.

The pattern of pixels on the substrate is shown in FIG. 5. Each group of electrodes creates a collection of 64 pixels that exhibit no shift or displacement along the direction of movement of the film of electrocoagulation printing ink relative to the printing head. This pixel pattern has been found to significantly improve the image quality since the saw-tooth effect is virtually eliminated. However, a shift occurs at the boundary between adjacent pixel collections formed by different electrode groups, such as for example, the collections formed at t1 and t2. Although being undesirable, such a shift has not been found particularly objectionable as it is very difficult to perceive visually.

The method consists of simultaneously energizing contiguous electrodes of the array, as described above, is capable of substantially eliminating the undesirable saw-tooth effect that occurs with prior art printing heads. In order to further improve the print quality, Applicant has discovered that by implementing a novel pixel density correction method, higher levels of precision in the optical densities of the pixels can be achieved. The term "pixel density" as used herein refers to the optical density of a pixel formed by electrocoagulation of the colloid present in an electrocoagulation printing ink. Without being bound by a certain theory, it is believed that a certain pixel density or shade unbalance can occur when contiguous electrodes of the array are simultaneously energized. This unbalance is believed to result from a certain impedance variation in the electrocoagulation printing ink, producing higher currents than those normally expected. Accordingly, the pixel density is higher particularly at light shaded areas. As discussed earlier, varying the duration of the current injection event controls the pixel density. Each driver module impresses at the respective electrode a constant voltage signal and the duration of that signal determines the level of pixel density. This mode of operation, however, is based on the assumption that the magnitude of the current through the film of electrocoagulation printing ink is constant. In most instances, this assumption is true. However, when a number of contiguous electrodes are energized simultaneously, the impedance may no longer remain constant and this creates for some of the electrodes higher currents than those normally expected.

One possibility to correct this potential difficulty is to alter the signal applied to the individual driver modules to compensate for the impedance imbalance. In a most preferred embodiment, the pixel density value associated with every electrode is compensated, the level of compensation being dependent upon the pixel density value of at least one neighboring electrode. Preferably, the level of compensation for one electrode is established on the basis of the pixel density values which are associated with the neighboring electrodes and which are numerically higher (lighter shades) than the pixel density value associated with the electrode being currently compensated.

Figure 6:
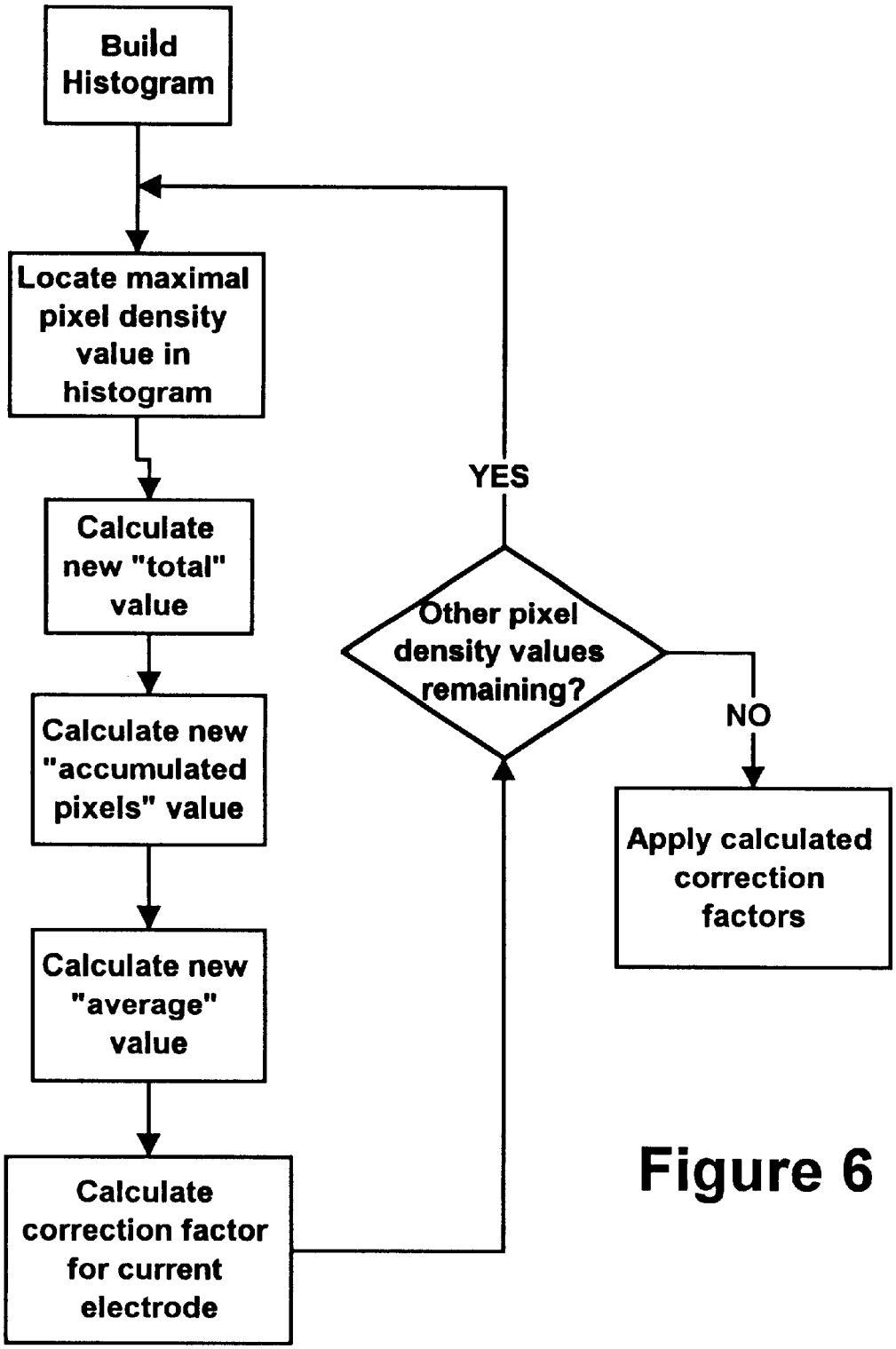
FIG. 6 is an algorithm for correcting pixel density values.

The method of correcting pixel density is illustrated in FIG. 6. The flow chart depicts an operational loop that examines the pixel density value associated with each electrode of a given group from the array. At every loop, a pixel density correction value is calculated for the current electrode and stored in a table. When the pixel density value for the last electrode in the group has been processed, the correction is implemented and the resulting corrected signal is transferred to the respective driver modules of the printing head.

The graphical data input signal which is applied to the printing head is a digital signal containing a number of discrete pixel density values. Typically, each pixel density value is an 8-bit string that can take 256 different values. In other words, each electrode can be assigned a pixel density value from 0 to 255, where 0 is black while 255 is white, the intermediate values designating different gray levels. For convenience, the shade values are being described in this example with reference to black and white printing. If another color is applied, say red, 0 will refer to pure red, 255 to absence of red, while the intermediate values will refer to different shades of red. In the absence of any correction, the 8-bit strings are transferred to the respective driver modules which apply corresponding signals to the electrodes, whose duration is determined by the magnitudes of the 8-bit strings.

Figure 7A:
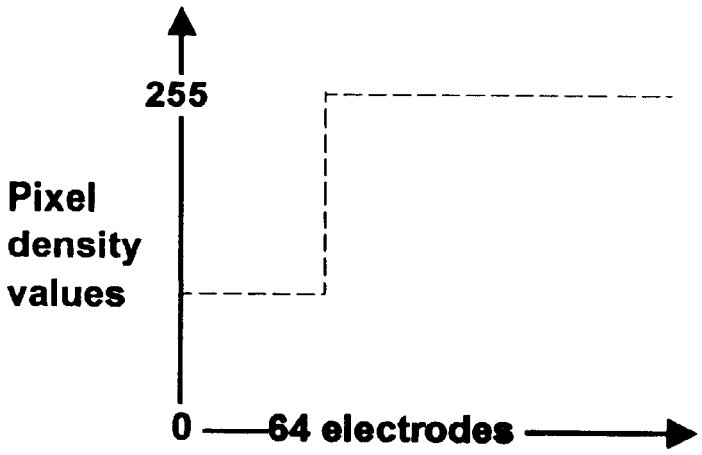
FIGS. 7*a* to 7*d* show graphs of pixel density values associated with a group of electrodes to illustrate the possible correction levels that may be implemented in dependence of the pixel values distribution profile.
Figure 7B:
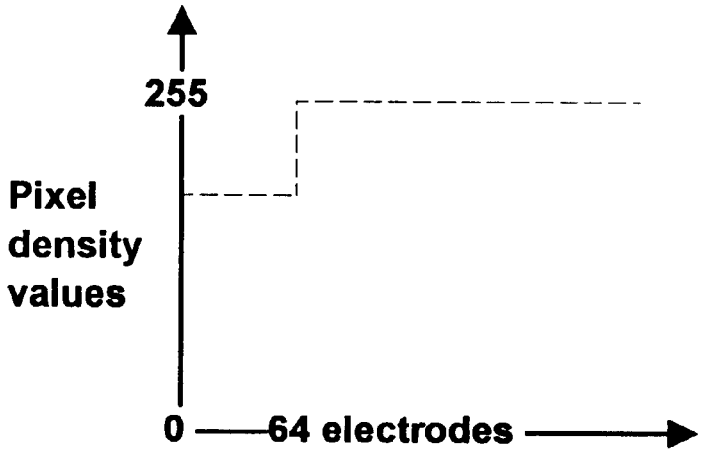
Figure 7C:
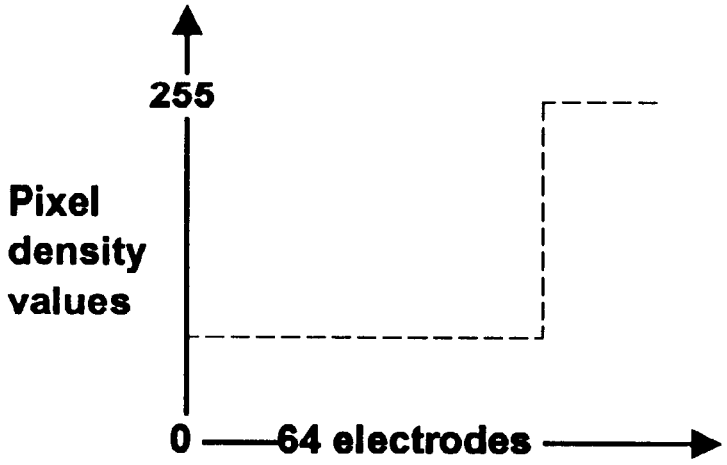
Figure 7D:
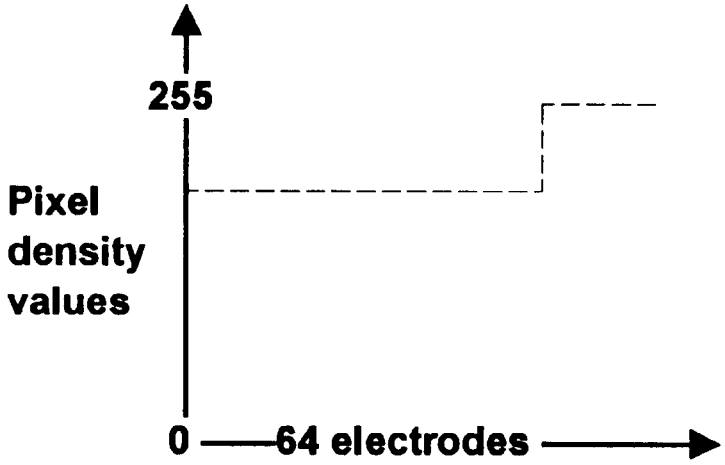

It has been found that an optimum area in the signal distribution path to effect the correction is at a point intermediate the source of the original digital signal and the driver modules. A pixel density correction system can be placed at any point location between these extremities to intercept the non-corrected digital signal, alter the signal in accordance with a predetermined algorithm and then transfer the corrected signal to the driver modules of the printing head. In a most preferred embodiment, the correction algorithm compares each pixel density value to the average pixel density values in the group denoting lower pixel densities (numerically higher values). If the given pixel density is far from the average, a strong correction will be required. Also, a strong correction will be made when there are many assigned lower pixel densities in the group. The correction is usually done by reducing the optical density of the pixel, in other words increasing the magnitude of the pixel density value. FIG. 7 illustrates typical situations:

a) In FIG. 7*a*, the density of the lower part of the electrode group is very far from average. Many pixels have a density lower than those of the lower part. Thus, a strong correction will be required.

b) In FIG. 7*b*, the density of the lower part of the electrode group is near average. Many pixels have a density inferior to those of the lower part. The correction will be less than for group a.

c) In FIG. 7*c*, the density of the lower part of the electrode group is very far from average. Few pixels have a density lower than those of the lower part. The correction will be less than for group a and similar to that of group b.

d) In FIG. 7*d*, the density of the lower part of the group is near average. Few pixels have a density inferior to those of the lower part. The correction will be the lightest of all four groups.

Referring back to FIG. 6, the first step of the correction algorithm is to analyze the digital signal in order to create a histogram of the pixel density values associated with a given electrode group. The objective is to classify the 64 random values in ascending order and associate with each discrete value the number of times it appears in the group, in other words, the number of electrodes that will be assigned this particular pixel density value. Consider the following example, where the term "frequency" refers to the number of times each pixel density value appears in the group:

| Pixel density value | Frequency |
|---|---|
| 000 | 0 |
| 001 | 2 |
| 002 | 0 |
| 003 | 1 |
| 004 to 252 | etc |
| 253 | 11 |
| 254 | 8 |
| 255 | 0 |

Once the histogram is built, the iteration process is initiated. The first step is to locate in the table the maximum pixel density value associated with an electrode. In this example, 255 is not a valid entry since no electrode is assigned this value. The next value (i.e. 254), however, is valid. The next step is to calculate a correction factor for this entry. The following variables are utilized in the calculation:

a) total: in this case total=maximum pixel density value (associated with a non-zero frequency)×frequency (i.e. 254×8), b) accumulated pixels=summation of the frequency value since the beginning of the iteration (in the first iteration, accumulated pixels=8), c) average=total/accumulated pixels (in the first iteration, the average is the same as total which in the example is 254).

The correction factor for the pixel density value 254 is obtained by means of the following equation: correction factor=((average−current pixel value)×total)/l, where l is a constant and the current pixel value for the first iteration is 254.

The constant l is used to calibrate the results of the above equation by introducing therein a value that permits to fine tune the pixel density value compensation. The constant l is obtained experimentally. More specifically, a constant l that has been used with success during tests conducted by Applicant is obtained from an array of 256 values that describe a logarithmic curve. The array is reproduced below. The value in brackets is an index allowing to retrieve from the array the value of the constant l.

| | | | | |
|---|---|---|---|---|
| l [0] = 100000 | l [1] = 100000 | l [2] = 99000 | l [3] = 99000 | l [4] = 99000 |
| l [5] = 99000 | l [6] = 99000 | l [7] = 99000 | l [8] = 98000 | l [9] = 98000 |
| l [10] = 98000 | l [11] = 98000 | l [12] = 98000 | l [13] = 98000 | l [14] = 97000 |
| l [15] = 97000 | l [16] = 97000 | l [17] = 97000 | l [18] = 97000 | l [19] = 97000 |
| l [20] = 96000 | l [21] = 96000 | l [22] = 96000 | l [23] = 96000 | l [24] = 96000 |
| l [25] = 96000 | l [26] = 95000 | l [27] = 95000 | l [28] = 95000 | l [29] = 95000 |
| l [30] = 95000 | l [31] = 95000 | l [32] = 94000 | l [33] = 94000 | l [34] = 94000 |
| l [35] = 94000 | l [36] = 94000 | l [37] = 94000 | l [38] = 94000 | l [39] = 93000 |
| l [40] = 93000 | l [41] = 93000 | l [42] = 93000 | l [43] = 93000 | l [44] = 93000 |
| l [45] = 93000 | l [46] = 92000 | l [47] = 92000 | l [48] = 92000 | l [49] = 92000 |
| l [50] = 92000 | l [51] = 92000 | l [52] = 92000 | l [53] = 91000 | l [54] = 91000 |
| l [55] = 91000 | l [56] = 91000 | l [57] = 91000 | l [58] = 91000 | l [59] = 91000 |
| l [60] = 90000 | l [61] = 90000 | l [62] = 90000 | l [63] = 90000 | l [64] = 90000 |
| l [65] = 90000 | l [66] = 90000 | l [67] = 89000 | l [68] = 89000 | l [69] = 89000 |
| l [70] = 89000 | l [71] = 89000 | l [72] = 89000 | l [73] = 89000 | l [74] = 88000 |
| l [75] = 88000 | l [76] = 88000 | l [77] = 88000 | l [78] = 88000 | l [79] = 88000 |
| l [80] = 88000 | l [81] = 87000 | l [82] = 87000 | l [83] = 87000 | l [84] = 87000 |
| l [85] = 87000 | l [86] = 87000 | l [87] = 87000 | l [88] = 86000 | l [89] = 86000 |
| l [90] = 86000 | l [91] = 86000 | l [92] = 86000 | l [93] = 86000 | l [94] = 86000 |
| l [95] = 85000 | l [96] = 85000 | l [97] = 85000 | l [98] = 85000 | l [99] = 85000 |
| l [100] = 85000 | l [101] = 84000 | l [102] = 84000 | l [103] = 84000 | l [104] = 84000 |
| l [105] = 84000 | l [106] = 84000 | l [107] = 83000 | l [108] = 83000 | l [109] = 83000 |
| l [110] = 83000 | l [111] = 83000 | l [112] = 83000 | l [113] = 82000 | l [113] = 82000 |
| l [114] = 82000 | l [115] = 82000 | l [116] = 82000 | l [117] = 82000 | l [118] = 82000 |
| l [119] = 81000 | l [120] = 81000 | l [121] = 81000 | l [122] = 81000 | l [123] = 81000 |
| l [124] = 81000 | l [125] = 80000 | l [126] = 80000 | l [127] = 80000 | l [128] = 80000 |
| l [129] = 80000 | l [130] = 80000 | l [131] = 79000 | l [132] = 79000 | l [133] = 79000 |
| l [134] = 79000 | l [135] = 78000 | l [136] = 78000 | l [137] = 78000 | l [138] = 78000 |
| l [139] = 77000 | l [140] = 77000 | l [141] = 77000 | l [142] = 76000 | l [143] = 76000 |
| l [144] = 76000 | l [145] = 75000 | l [146] = 75000 | l [147] = 75000 | l [148] = 74000 |
| l [149] = 74000 | l [150] = 74000 | l [151] = 73000 | l [152] = 73000 | l [153] = 73000 |
| l [154] = 72000 | l [155] = 72000 | l [156] = 72000 | l [157] = 71000 | l [158] = 71000 |

-continued

| | | | | |
|---|---|---|---|---|
| l [159] = 71000 | l [160] = 70000 | l [161] = 70000 | l [162] = 70000 | l [163] = 69000 |
| l [164] = 69000 | l [165] = 69000 | l [166] = 68000 | l [167] = 68000 | l [168] = 68000 |
| l [169] = 67000 | l [170] = 67000 | l [171] = 67000 | l [172] = 66000 | l [173] = 66000 |
| l [174] = 66000 | l [175] = 65000 | l [176] = 65000 | l [177] = 65000 | l [178] = 64000 |
| l [179] = 64000 | l [180] = 63000 | l [181] = 63000 | l [182] = 62000 | l [183] = 62000 |
| l [184] = 61000 | l [185] = 61000 | l [186] = 60000 | l [187] = 60000 | l [188] = 59000 |
| l [189] = 59000 | l [190] = 58000 | l [191] = 58000 | l [192] = 57000 | l [193] = 57000 |
| l [194] = 56000 | l [195] = 56000 | l [196] = 55000 | l [197] = 55000 | l [198] = 54000 |
| l [199] = 54000 | l [200] = 53000 | l [201] = 53000 | l [202] = 52000 | l [203] = 52000 |
| l [204] = 51000 | l [205] = 51000 | l [206] = 50000 | l [207] = 50000 | l [208] = 49000 |
| l [209] = 49000 | l [210] = 48000 | l [211] = 48000 | l [212] = 47000 | l [213] = 47000 |
| l [214] = 46000 | l [215] = 46000 | l [216] = 45000 | l [217] = 45000 | l [218] = 44000 |
| l [219] = 44000 | l [220] = 43000 | l [221] = 43000 | l [222] = 42000 | l [223] = 41000 |
| l [224] = 41000 | l [225] = 40000 | l [226] = 40000 | l [227] = 39000 | l [228] = 39000 |
| l [229] = 38000 | l [230] = 38000 | l [231] = 37000 | l [232] = 37000 | l [233] = 36000 |
| l [234] = 36000 | l [235] = 35000 | l [236] = 34000 | l [237] = 33000 | l [238] = 32000 |
| l [239] = 31000 | l [240] = 30000 | l [241] = 29000 | l [242] = 28000 | l [243] = 27000 |
| l [244] = 26000 | l [245] = 25000 | l [246] = 24000 | l [247] = 23000 | l [248] = 22000 |
| l [249] = 21000 | l [250] = 20000 | l [251] = 18000 | l [252] = 16000 | l [253] = 14000 |
| l [254] = 12000 | l [255] = 10000 | | | |

The specific value l used depends upon the operational conditions of the printing apparatus. If these conditions are changed, a different l value is used to fine-tune the correction factor. It is also possible to apply modifiers to the constant l in order to compensate for changes that may occur during utilization of the printing apparatus. Two type of modifiers can be implemented:

1—additive modifier (offset)

Adds a constant value (offset) to each entry in the array of values for the constant l. The offset can vary (for example) from −9999 to +50000. The neutral element is zero. The effect of this offset on the constant l increases with the magnitude of the absolute value of the offset.

2—multiplicative modifier (gain)

Multiplies each entry in the array of values for the constant l. The gain can vary (for example) from 0.2 to 5.0. The neutral element is 1. The effect of this gain on the constant l increases as the magnitude of the gain value differs from the neutral element.

The modifiers can be used in the following fashion to alter the values in the array:

$$l[x]=(\text{offset}+\text{original } l\,[x])\times\text{gain}$$

where l[x] is the modified value stored at index x in the array (x having a value from 0 to 255), and original l[x] is the original value at index x in the array.

The following tables describe the effect of the modifiers:

| OFFSET | Effect on low densities | Effect on high densities |
|---|---|---|
| Lower than 0: −9999 < Offset < 0 | Correction greatly increased | Correction slightly increased |
| Greater than 0: 0 < Offset < 50000 | Correction greatly decreased | Correction slightly decreased |

| GAIN | Effect on low densities | Effect on high densities |
|---|---|---|
| Lower than 1: 0.2 < Gain < 1.0 | Correction moderately increased | Correction greatly increased |
| Greater than 1: 1.0 < Gain < 5.0 | Correction moderately decreased | Correction greatly decreased |

Once the appropriate value of the constant l is selected from the array, the correction factor is calculated and stored.

The process continues by initiating another iteration for the next pixel density value in the table (i.e. 253). The first step is to update the total variable. The updated variable total=total+(current pixel density value×frequency) For this iteration, the current pixel density value is 253 and the frequency 11. As a result, the value of the updated total variable is 4815. In general terms, the variable total can thus be mathematically expressed as $$\sum_{i=a}^{\max} P_i N$$

where:

the range a to max is an index range in the table of pixel density values, the index i in that range pointing to pixel density values exceeding or equal to the pixel density value associated with a given electrode;

$P_i$ is the pixel density value at the value taken by index i; in the example shown above the i and $P_i$ are the same values; and N is the number of electrodes assigned the pixel density value $P_i$ taken by i at a given iteration from a to max.

In the next step of the process, the accumulated pixels variable is updated. The updated variable accumulated pixels=accumulated pixels+frequency. Here, the updated accumulated pixels equals 8+11=19. In general terms, the variable total can thus be mathematically expressed as $$\sum_{i=a}^{max} N$$

The following step is to update the value of the variable average. For this iteration, the ed value of average is 4815 (updated total value)/19 (updated accumulated pixels value)=253.42.

The final step is to calculate the correction factor. Using the above formula, the value of correction factor=((253.42−253)×4815)/l is obtained and stored.

The final step of the iteration is to determine if other pixel density values remain in the histogram. In other words, does the histogram contain other valid pixel density values less than the current value. In the affirmative, a new loop is initiated, otherwise the procedure terminated. If the procedure is indeed ended, the system then simply adds the correction factors to the original pixel density values. For example:

| Electrode number | Original pixel density value | Correction factor | Final pixel density value |
|---|---|---|---|
| 0 | 117 | 9 | 126 |
| 1 | 254 | 0 | 254 |
| 2 | 253 | 0 | 253 |
| 3 | 212 | 2 | 214 |
| 4 to 60 | — | — | — |
| 61 | 198 | 3 | 201 |
| 62 | 198 | 3 | 201 |
| 63 | 220 | 1 | 221 |

Figure 8:
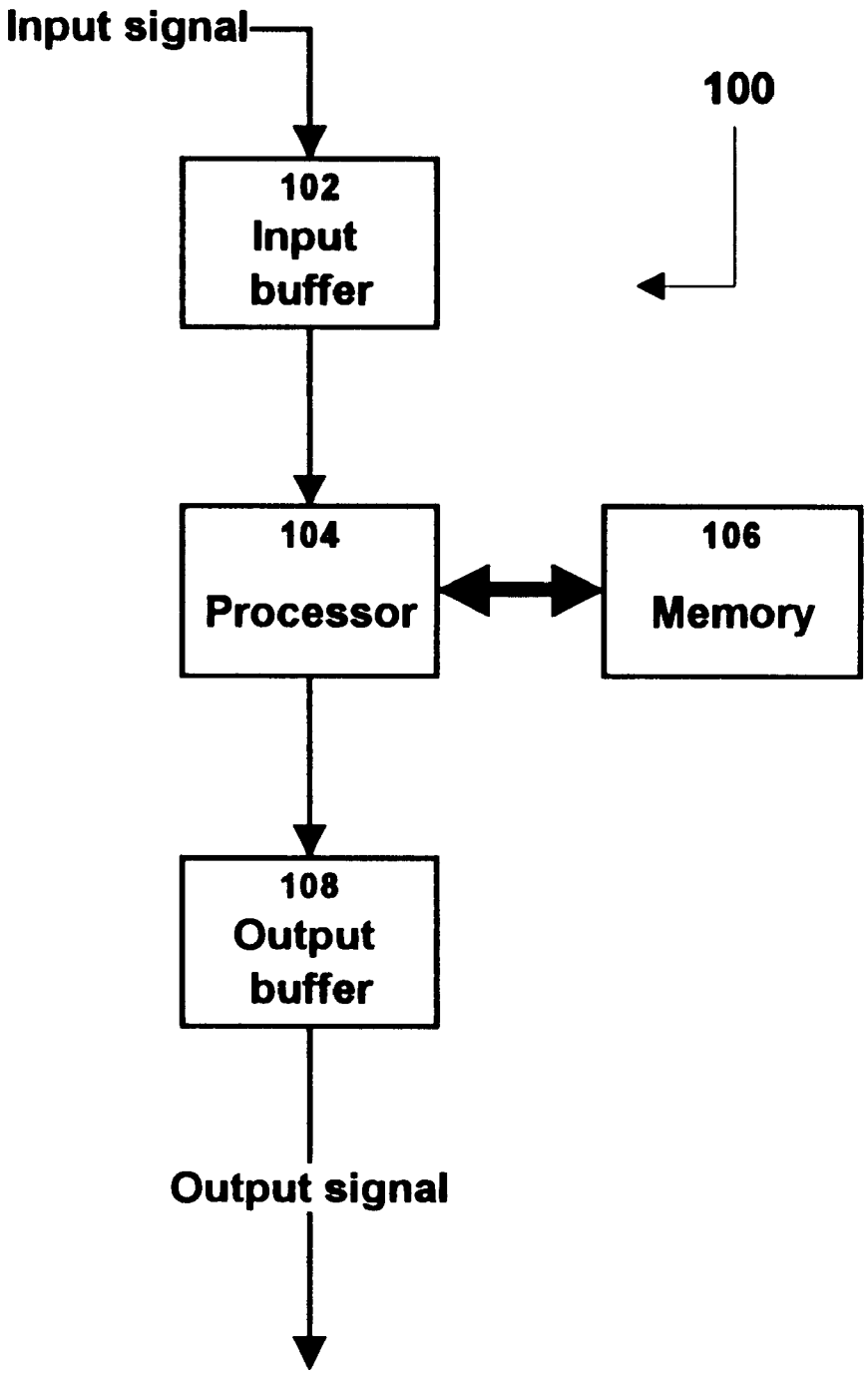
FIG. 8 is a block diagram of an electronic device for effecting pixel density correction.

Most preferably, the pixel density correction system is implemented by using the electronic device 100 illustrated in FIG. 8. The device 100 comprises an input buffer 102 which receives the digital signal containing the pixel density values. A processor 104 operates on the data placed in the input buffer 102 in accordance with instructions stored in a memory 106. The corrected pixel density values are then transferred to an output buffer 108 that issues a modified digital signal directed to the printing head.

Figure 9:
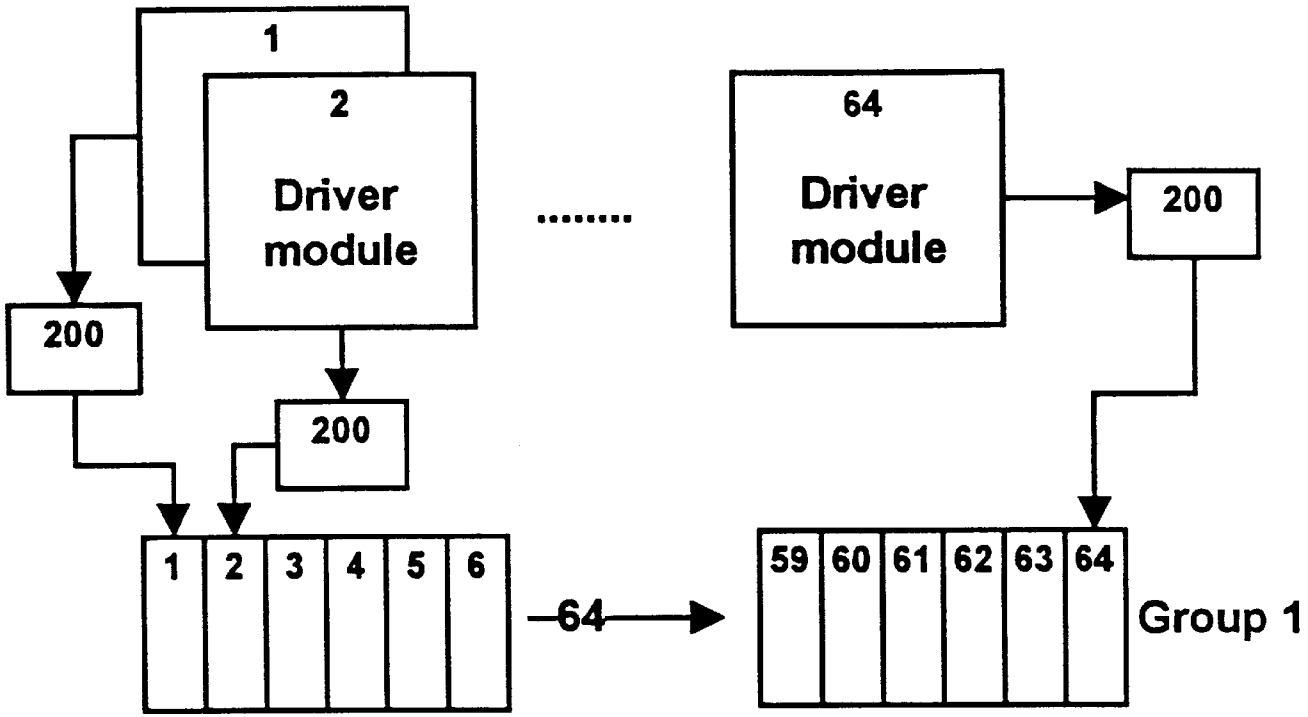
FIG. 9 is a schematic view illustrating a printing head provided with a driver circuit featuring a current limiting system, in accordance with a preferred embodiment of the invention.

In a different embodiment, the printing head is provided with a driver circuit featuring a current limiting system for restricting the magnitude of electric current passing through the electrodes of the array at predetermined levels. This arrangement is capable of avoiding the occurrence of overly dense pixels on the substrate, caused by impedance variations in the electrocoagulation printing ink, without the necessity of implementing a pixel density value correction system of the type described above. The printing head arrangement is schematically depicted in FIG. 9. For simplicity, only a single electrode group has been depicted. The system resides in the inclusion of a current source 200 associated with each electrode, that can be integrated in the respective driver module. Each current source feeds only a current of predetermined magnitude to the respective electrode, with the result that the impedance of the electrocoagulation printing ink no longer determines the current magnitude. Thus, impedance variations in the electrocoagulation printing ink are not likely to cause any current magnitude changes.

The current source can be of any appropriate design. Most preferably, the current source is selected to maintain the current constant during the current injection event. For example, use can be made of the adjustable voltage regulator sold under part No. LM117HV by National Semiconductor Corporation, having an output terminal and an adjustment terminal with a resistor connected therebetween. In operation, the LM117HV develops a nominal 1.2 V reference voltage between the output and adjustment terminals and, since the voltage is constant, a constant current flows through the resistor. Thus, by selecting a 12 Ω resistor, a constant current of 100 mA is delivered to the electrodes. This current will remain constant even if there are variations in the electrical resistance of the film of electrocoagulation printing ink. Another possibility is to use a hybrid circuit that is designed to prevent the current from exceeding a predetermined value. In this embodiment, the impedance of the electrocoagulation printing ink determines the current magnitude, as long as this magnitude remains within a predetermined operational range. However, should the impedance drop, the current reaches the upper extremity of the range and it is forced to remain there to avoid overcoagulation of the ink.

We claim:

1. An electrocoagulation printing apparatus comprising a printing head carrying a linear array of electrolytically inert electrodes electrically insulated from one another and in contact with an electrically conductive electrocoagulation printing ink, said array of electrodes being arranged into a plurality of groups each having a predetermined number of closely spaced electrodes; and a signal processing device for correcting ink film pixel density, said signal processing device including an input for receiving a signal representative of an ink film pixel density value associated with each electrolytically inert electrode in one of said groups of electrolytically inert electrodes and with said electrocoagulation printing ink, a signal processing circuit for altering an ink film pixel density value associated with a selected electrode in said one group of electrodes at least partially in dependence of ink film pixel density values associated with other electrodes in said one group, thereby providing an altered ink film pixel density value and compensating for an impedance factor introduced by adjacent pixel density values, and an output coupled to the selected electrode for supplying thereto the altered ink film pixel density value.

2. The apparatus as defined in claim 1, wherein said processing circuit includes means for processing ink film pixel density values associated with a plurality of electrodes in said one group and computing a correction factor for altering the ink film pixel density value associated with said selected electrode.

3. The apparatus as defined in claim 2, wherein said means for processing ink film pixel density values includes means for adding said correction factor to said ink film pixel density value associated with said selected electrode to alter said ink film pixel density value.

4. The apparatus as defined in claim 2, wherein said correction factor is function of ink film pixel density values indicative of an ink film pixel density higher than the ink film pixel density value associated with said selected electrode.

5. The apparatus as defined in claim 2, wherein said correction factor is function of ink film pixel density values indicative of an ink film pixel density not less than the ink film pixel density value associated with said selected electrode.

6. The apparatus as defined in claim 2, wherein said correction factor is at least partly function of a variable k defined as:

$$k = \sum_{i=a}^{\max} P_i N$$

where:

1)range a to max is an index range in a table of pixel density values, the index i in said range pointing to pixel density values exceeding the pixel density value associated with said selected electrode;

2) $P_i$ is the pixel density value at the value taken by index i; and

3) N is a number of electrodes assigned the pixel density value $P_i$ taken by i at a given iteration from a to max.

7. The apparatus as defined in claim 2, wherein said correction factor is at least partly function of a variable k defined as:

$$k = \left(\sum_{i=a}^{\max} P_i N\right) \div \left(\sum_{i=a}^{\max} N\right)$$

where:

1) range a to max is an index range in a table of pixel density values, the index i in said range pointing to pixel density values exceeding the pixel density value associated with said selected electrode;

2) $P_i$ is the pixel density value at the value taken by index i; and

3) N is a number of electrodes assigned the pixel density value $P_i$ taken by i at a given iteration from a to max.

8. The apparatus as defined in claim 2, wherein said correction factor is at least partly function of a variable k defined as:

$$k = \left(\left(\sum_{i=a}^{\max} P_i N\right) \div \left(\sum_{i=a}^{\max} N\right) - j\right) \times \left(\sum_{i=a}^{\max} P_i N\right)$$

where:

1) range a to max is an index range in a table of pixel density values, the index i in said range pointing to pixel density values exceeding the pixel density value associated with said selected electrode;

2) $P_i$ is the pixel density value at the value taken by index i;

3) N is a number of electrodes assigned the pixel density value $P_i$ taken by i at a given iteration from a to max; and 4) variable j is the pixel density value associated with said selected electrode.

9. The apparatus as defined in claim 2, wherein said correction factor is at least partly function of a variable k defined as:

$$k = \left(\left(\left(\sum_{i=a}^{\max} P_i N\right) \div \left(\sum_{i=a}^{\max} N\right) - j\right) \times \left(\sum_{i=a}^{\max} P_i N\right)\right) \div l$$

where:

1) range a to max is an index range in a table of pixel density values, the index i in said range pointing to pixel density values exceeding the pixel density value associated with said selected electrode;

2) $P_i$ is the pixel density value at the value taken by index i;

3) N is a number of electrodes assigned the pixel density value $P_i$ taken by i at a given iteration from a to max;

4) variable j is the pixel density value associated with said selected electrode; and 5) variable l is an adjustment constant associated with each pixel density value $P_i$.

10. An ink film pixel density correction device for processing a signal containing ink film pixel density values conveyed to a printing head of an electrocoagulation printing apparatus that includes a plurality of simultaneously addressable electrodes in contact with an electrically conductive electrocoagulation printing ink, said ink film pixel density correction device including:

an input for receiving said signal representative of ink film pixel density values associated with simultaneously addressable electrodes and with electrocoagulation printing ink, and a processing element for altering an ink film pixel density value of a selected one of said simultaneously addressable electrodes and compensating for an impedance factor introduced by adjacent pixel density values, said signal processing element being responsive to ink film pixel density values associated with electrodes other than said selected electrode to determine a corrected ink film pixel density value associated with said selected electrode.

11. An ink film pixel density correction device as defined in claim 10, wherein said processing element determines a corrected ink film pixel density value for every electrode of said plurality of simultaneously addressable electrodes.

12. An ink film pixel density correction device as defined in claim 10, wherein said processing element reduces the ink film pixel density value associated with said selected electrode in dependence of ink film pixel density values associated with electrodes other than said selected electrode.

13. A method of correcting ink film pixel density, comprising the steps of:

a) processing a signal containing ink film pixel density values conveyed to a printing head of an electrocoagulation printing apparatus that includes a plurality of simultaneously addressable electrodes in contact with an electrically conductive electrocoagulation printing ink to determine a corrected ink film pixel density value for a selected one of said simultaneously addressable electrodes in dependence of ink film pixel density values associated with electrodes other than said selected electrode and with said electrocoagulation printing ink and to compensate for an impedance factor introduced by adjacent pixel density values; and b) outputting the corrected ink film pixel density value.

14. A method as defined in claim 13, further including the step of determining for each electrode of said plurality of electrodes a corrected ink film pixel density value in dependence of ink film pixel density values other than the ink film pixel density value associated with each electrode.

* * * * *

UNITED STATES PATENT AND TRADEMARK OFFICE

CERTIFICATE OF CORRECTION

PATENT NO. : 6,249,298 B1
DATED : June 19, 2001
INVENTOR(S) : Castegnier et al.

It is certified that error appears in the above-identified patent and that said Letters Patent is hereby corrected as shown below:

Column 7,
Line 2, delete the number "25";

Column 11,
Line 27, replace "type" with -- types --;

Column 12,
Line 40, add a period after the expression "total = total + (current pixel density value x frequency)";

Column 13,
Line 7, replace "the ed value" with -- the updated value --.

Signed and Sealed this

Sixth Day of May, 2003

JAMES E. ROGAN
*Director of the United States Patent and Trademark Office*